US005388974A

United States Patent [19]

Streiff

[11] Patent Number: 5,388,974

[45] Date of Patent: Feb. 14, 1995

[54] GEAR PUMP

[75] Inventor: Felix Streiff, Winterthur, Switzerland

[73] Assignee: Sulzer Chemtech AG, Winterthur, Switzerland

[21] Appl. No.: 134,776

[22] Filed: Oct. 12, 1993

[30] Foreign Application Priority Data

Oct. 29, 1992 [CH] Switzerland ..... 03379/92

[51] Int. Cl.[6] ..... F01C 1/24

[52] U.S. Cl. ..... 418/206

[58] Field of Search ..... 418/206, 205

[56] References Cited

U.S. PATENT DOCUMENTS

| | | | |
|---|---|---|---|
| 2,531,726 | 11/1950 | Durdin . | |
| 3,746,481 | 7/1973 | Schippers | 418/206 |
| 3,837,768 | 9/1974 | Haupt | 418/206 |
| 4,137,023 | 1/1979 | Moked | 418/15 |
| 4,737,087 | 4/1988 | Hertell | 418/206 |

FOREIGN PATENT DOCUMENTS

| | | | |
|---|---|---|---|
| 0189670 | 8/1986 | European Pat. Off. . | |
| 1073834 | 9/1954 | France | 418/206 |

*Primary Examiner*—Richard A. Bertsch
*Assistant Examiner*—Charles G. Freay
*Attorney, Agent, or Firm*—Townsend and Townsend Khourie and Crew

[57] ABSTRACT

Disclosed is a gear pump which is especially suitable for discharging highly viscous media from a vacuum against a high delivery pressure. It includes a pair of gear wheels (2) and an inlet and outlet area in one housing. The inlet (4) has an enlargement (10) that extends at least as far as the plane (11) of the gear wheel axes (12). The length R of this enlargement parallel to the plane of the gear wheel axes and at right angles to the gear wheel axes is larger than the length D of the pair of gear wheels. According to this invention the enlargement (10) of gear wheels (2) has a width c in the direction of the gear wheel axes (12) which is greater than the tooth width T.

26 Claims, 5 Drawing Sheets

GEAR PUMP

BACKGROUND OF THE INVENTION

The invention concerns a gear pump capable of pumping high viscosity media from a relatively low pressure against a relatively high pressure. This invention also concerns pump installations with such a gear pump as well as the use of this gear pump, especially for discharging high viscosity media from a vacuum against a high pressure.

In the past, when pumping a highly viscous medium from a vacuum or an area of low pressure against a high pressure the medium being pumped had a tendency to boil or form gases. This in turn led to cavitations in the pump which drastically reduced its capacity. To prevent the development of gas and cavitation, it is necessary to increase the inlet pressure to a suitably high level by increasing the static pressure of the liquid column above it. Cavitation in the pump must be avoided at all costs because it not only causes the output of the pump to stop, it also damages the pump itself. To achieve a good pumping capacity, the inlet area of known gear pumps has been designed in such a way that the medium is fed directly to the gears. Such a pump is known from U.S. Pat. No. 4,137,023.

SUMMARY OF THE INVENTION

The object of the present invention is to create a pump with much higher capacity than known pumps and, especially, one which can reliably pump a highly viscous medium including volatile components from a vacuum against delivery pressures as high as 100 to 250 bar, while requiring a very low intake elevation.

This object is achieved with a pump having an inlet of a cross section which is greater than that of the rectangular cross-sectional area of the gear wheels so that the inlet cross section of the gear wheels is wider in the direction of the gear axes than the gear wheels themselves. This creates more favorable inflow conditions and, instead of a pressure drop in the inlet area, there is actually a slight increase in pressure as a result of the static liquid pressure of the medium in the inlet area.

To achieve especially good pump properties, the enlargement in the inlet area may extend all the way to the plane of the gear wheel axes, and the length R of the enlargement can be at least 10% larger than the length D of the pair of gear wheels. The enlargement of the inlet area may have a width C that is larger than the tooth width T by at least 10%, for example. A favorable inlet geometry can also be achieved by maintaining a ratio of the inlet diameter B to the inlet depth L of at least 2 and a ratio of the enlargement length R to the inlet depth L that is greater than 1.85. A funnel-shaped inlet area preferably has a tapered angle W of at least 55°. A favorable gear wheel geometry can be achieved with a ratio of the width T to the axial spacing Z between the gear wheels of between 0.9 and 1.3, and an especially well-coordinated outlet geometry is obtained with a ratio of the outlet diameter A to the diagonal D4 of the cross-sectional area FA of between 0.9 and 1.1, where FA is the tooth width T times the axial spacing Z. A cost-effective modular design enables the use of the pumps of the present invention in the same housing with different tooth sizes and correspondingly shaped, interchangeable inlet areas and outlet diameters. To do so, the outlet diameter A can be appropriately sized with a fitted bushing. An especially efficient pumping and mixing installation is formed with a gear pump according to this invention in combination with a downstream static mixing element. A simple and efficient pumping and degassing installation is obtained by combining a gear pump made according to this invention with a degassing chamber for the discharge of highly viscous media from the chamber against a high delivery pressure.

DESCRIPTION OF THE PREFERRED EMBODIMENTS

Figure 1B:
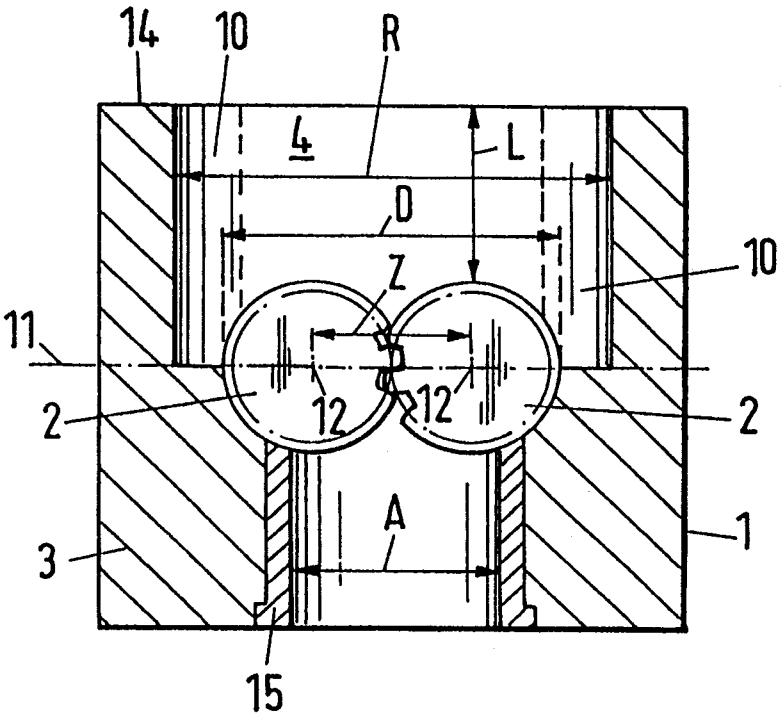
FIGS. 1*a*, 1*b* and 2 show a gear pump according to this invention in three views having an enlarged inlet.
Figure 1A:
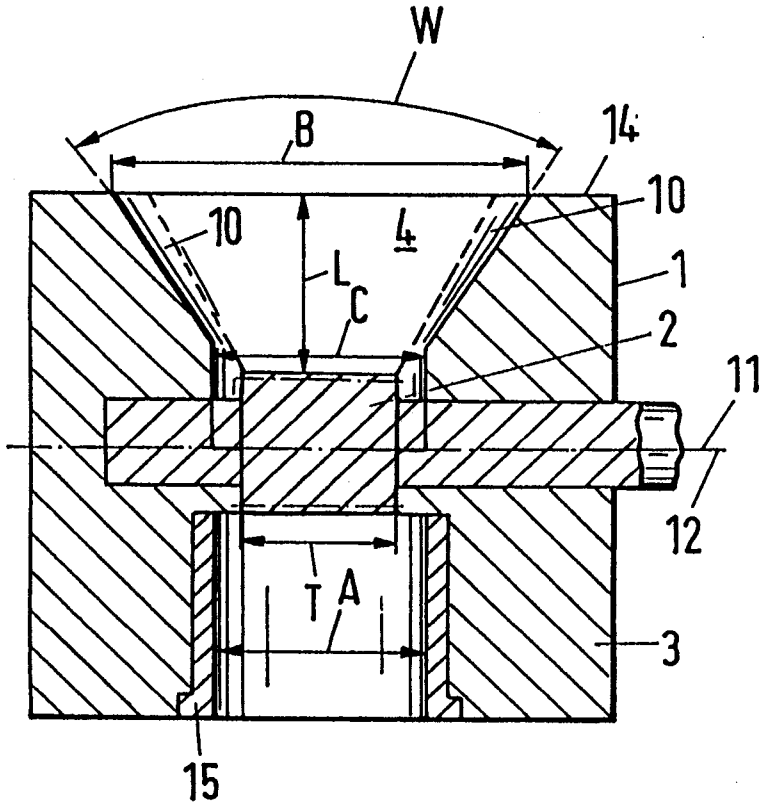
Figure 2:
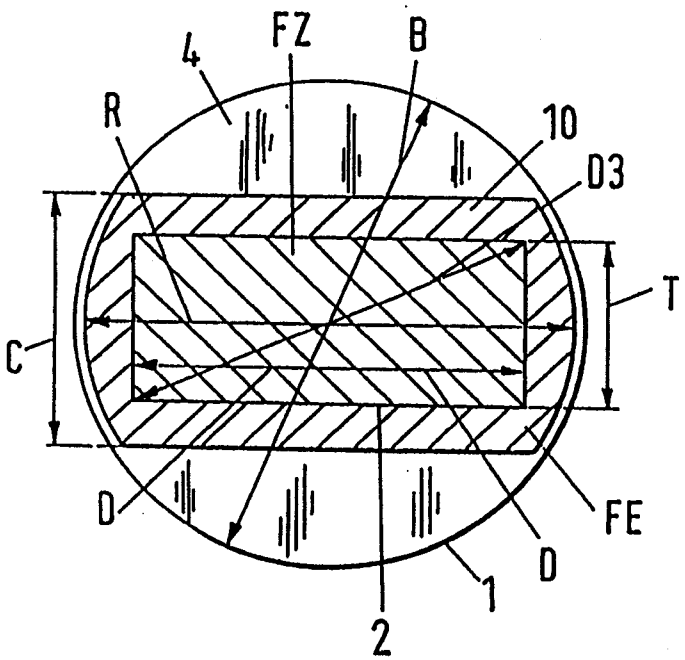

According to FIG. 1, gear pump 1 of the present invention has an inlet 4, an outlet 6 and a pair of gear wheels 2 in a housing 3. The inlet 4 has an enlargement 10 that extends to the plane 11 of the gear wheel axes 12. FIG. 2 shows the cross-sectional area FZ of the gear wheels 2 in the form of a rectangle D x T corresponding to the length D and the width T of the pair of gear wheels. The enlargement 10 has a cross-sectional area FE with a length R and a width C. The enlargement is funnel shaped or conical and is defined by flat surfaces. The funnel shaped part of the inlet has an included angle or a cone angle W with an inlet diameter B in the upper flange plane 14. According to claim 1 the cross-sectional area FE of the enlargement (in the area of the gear wheel axes) is in all cases larger than that of the gear wheels FZ, and the diagonal D3 of the cross-sectional area FZ of the gear wheels is always smaller than the inlet diameter B. In this Example 1, the length R as well as the width C of the enlargement FE are both larger than the corresponding length D and the width T of the cross-sectional area FZ of the gear wheel.

Figure 4:
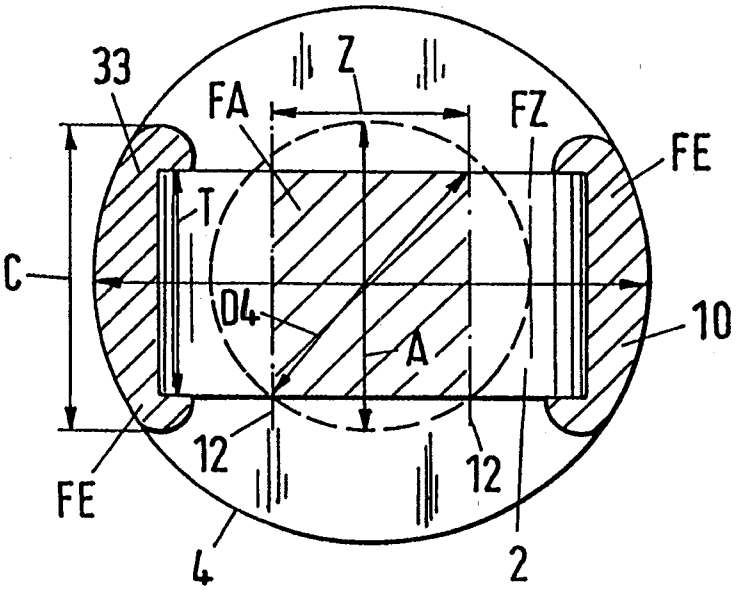
FIGS. 3 and 4 are examples of cross-sectional areas of enlarged inlets.
Figure 3:
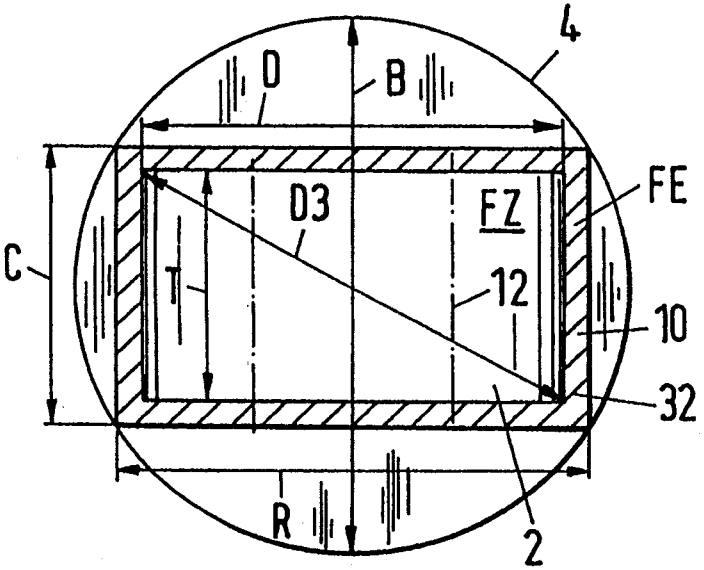

Additional examples of cross-sectional areas FE are shown in FIGS. 3 and 4. The cross-sectional area 32 in FIG. 3 is also rectangular, as is the cross-sectional area FZ of the gear wheels. The cross-sectional area 33 in FIG. 4 shows as another advantageous example a rounded, sickle-shaped enlargement 33 in the area of the exterior teeth of the pair of gear wheels 2. FIG. 4 also shows the cross-sectional area FA formed by the axial spacing Z and the tooth width T. The outlet diameter A should then substantially correspond to the diagonal D4 of cross-sectional area FA. The ratio of the outlet diameter A to the diagonal D4 is preferably in the range of 0.9 to 1.1. The capacity of the gear pump is readily and cost-effectively changed by using the same housing 2 with differently sized insert bushings 15 (FIGS. 1*a* and *b*), by varying the tooth width T, and by correspondingly changing the size of inlet enlargement 10 accordingly.

Figure 5:
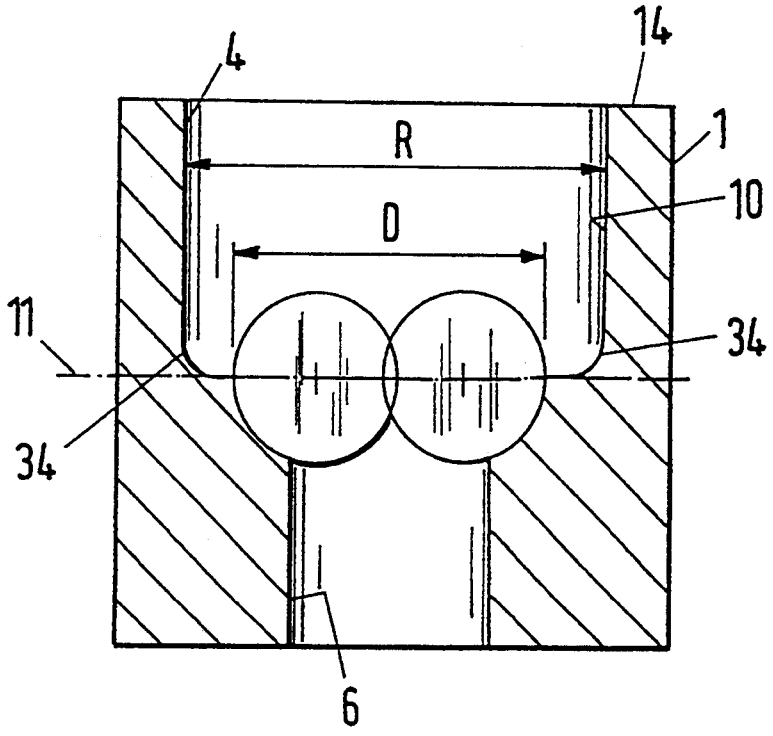
FIGS. 5 and 6 are examples of the inlet enlargements up to the plane of the gear axes.
Figure 6:
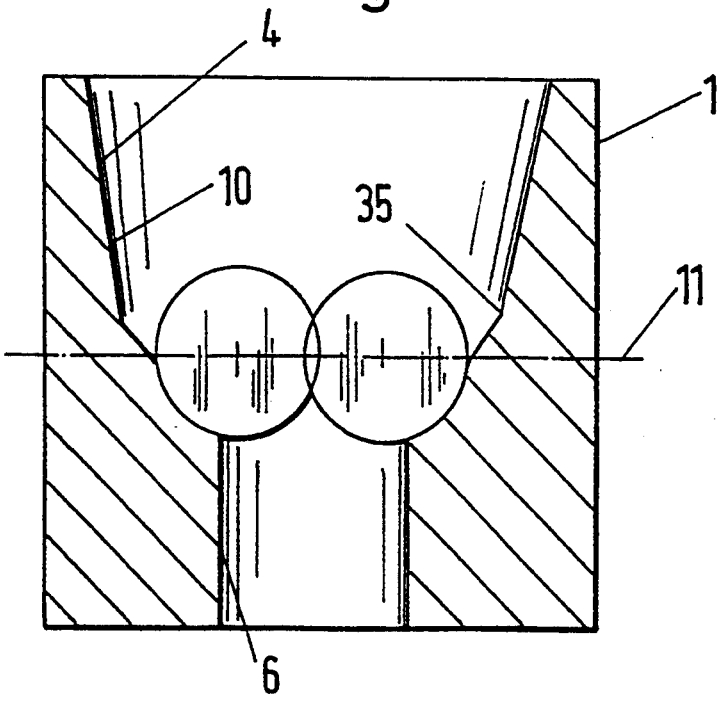

FIGS. 5 and 6 show other examples of the vertical configuration of enlargement 10. In FIG. 5 the enlargement 10 first extends vertically downward and then merges along a curvature 34 into the axial plane 11. In FIG. 6 the enlargement 10 tapers to the axial plane 11, and is bordered by the stepped, inclined planes 35.

Figure 8:
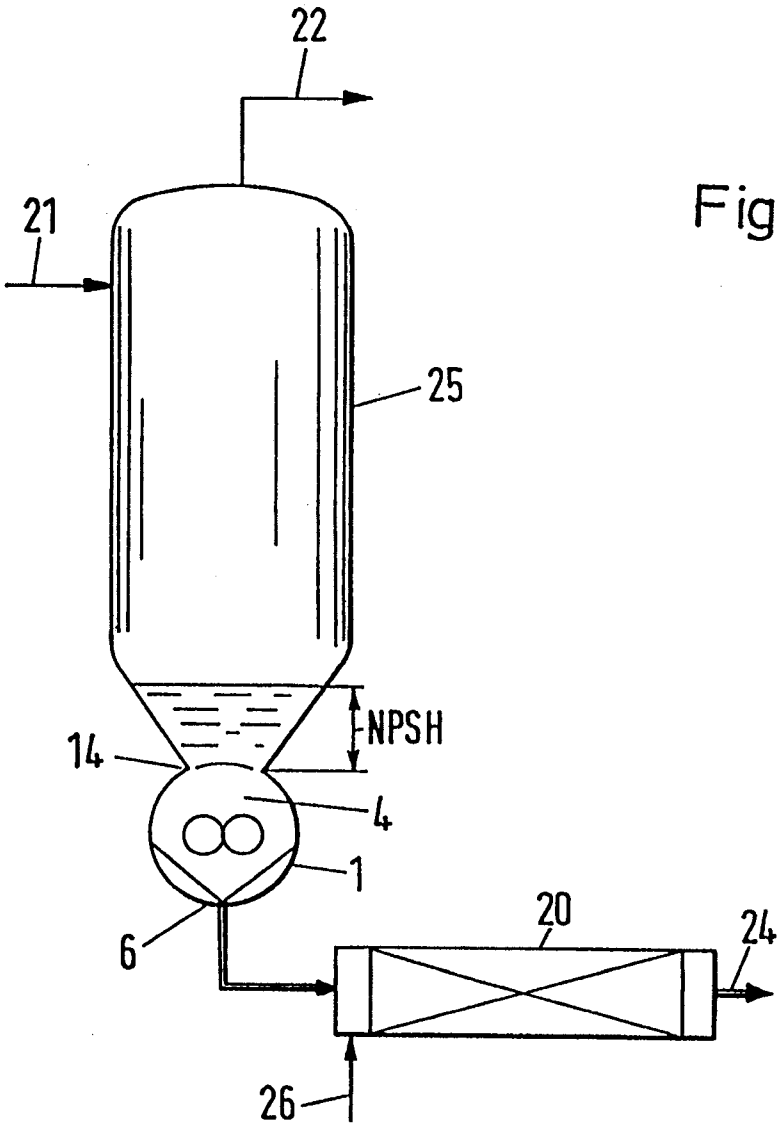
FIG. 8 shows an installation for pumping, mixing and degassing, including a degassing chamber and a static mixer.
Figure 7:
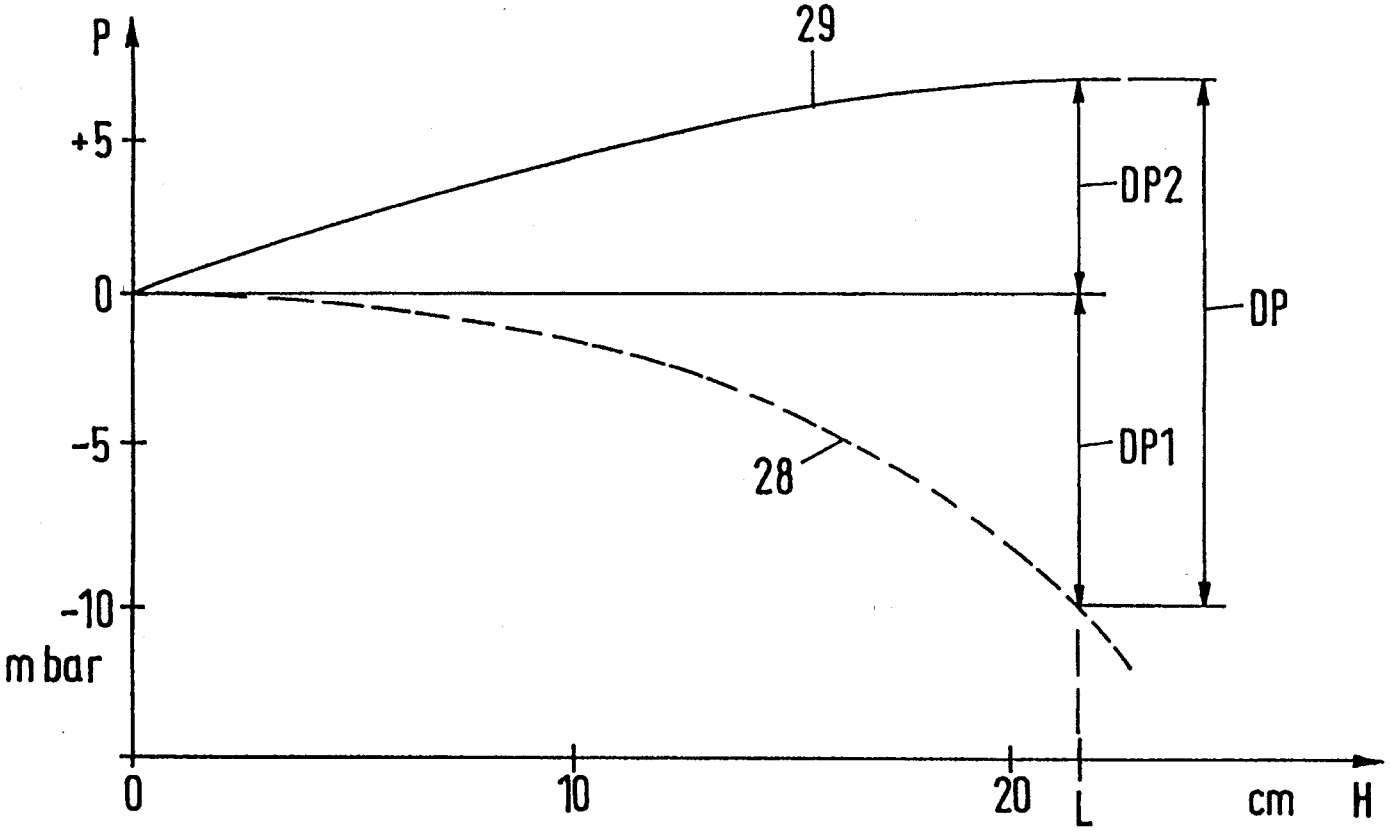
FIG. 7 shows the pressure curves in the inlet area for a conventional gear pump and a gear pump made according to this invention.

FIG. 7 shows the pressure curves in the inlet area for a conventional gear pump (curve 28) and for a gear pump made according to the present invention (curve 29) (both having the same delivery rate and the same product viscosity). The curves show how the pressure P varies as a function of the depth H all the way to the gear wheels, starting from a reference pressure 0 at the inlet flange 14. According to curve 28, conventional pumps experience a pressure drop DP1 of 10 mbar, for example, to depth L. However, there is a slight increase in pressure DP2 of 7 mbar, for example, when the pump of the present invention is used as is illustrated by curve 29. The improvement consists of a very significant pressure difference DP=DP1+DP2 of 17 mbar, for example. This means that a lower filling level NPSH (see FIG. 8), which reflects this difference, can be employed to avoid cavitation in the pump. FIG. 8 shows an installation for pumping, mixing and degassing polymer melts, for example, PE, PS or PMMA with an inlet 21, a degassing chamber 25, a pump 1 made according to this invention that delivers the medium into a static mixing element 20, and an outlet 24. Solvent and monomer are removed from degassing chamber 25 through a vapor vent 22. The intake of the mixer 20 can be supplied with additives through another inlet 26. With the gear pump according to the present invention, or with an installation as shown in FIG. 8, the high degree of degassing that is always important in processing plastics is cost-effectively attained with a relatively simple static degassing method.

What is claimed is:

1. A gear pump, comprising:

a pair of gear wheels each having a gear wheel axis, the pair of gear wheels having a length and a tooth width;

a housing having an outlet area; and an inlet area having an enlargement extending at least to a plane in which both gear wheel axes lie, the enlargement having an enlargement length being parallel to the plane and being at a right angle to the gear wheel axes, the enlargement length being larger than the length of the pair of gear wheels, the enlargement having an inlet width at the gear wheels in a direction of the gear wheel axes, the inlet width being greater than the tooth width, the inlet area also having an inlet depth and an inlet diameter at an entrance, a ratio of the inlet diameter to the inlet depth being at least 2.

2. Gear pump according to claim 1, wherein:

the pair of gear wheels have a rectangular cross-sectional area and a diagonal across the rectangular cross-sectional area; and the inlet area has a cross-sectional area which decreases in a flow direction, the inlet diameter being larger than the diagonal of the rectangular cross-sectional area.

3. Gear pump according to claim 1, wherein:

the enlargement length is at least 10% larger than the length of the pair of gear wheels.

4. Gear pump according to claim 1, wherein:

the inlet width is at least 10% larger than the tooth width.

5. Gear pump according to claim 1, wherein:

a ratio of the enlargement length to the inlet depth is greater than 1.85.

6. Gear pump according to claim 1, wherein:

the inlet area comprises a funnel shape having a cone angle of at least 55°.

7. Gear pump according to claim 1, wherein:

the pair of gear wheels has an axial distance between the gear wheel axes; and a ratio of the tooth width to the axial distance is between 0.9 and 1.3.

8. Gear pump according to claim 1, wherein:

the gear wheel axes of the pair of gear wheels are separated by an axial spacing, the axial spacing and the tooth width defining a cross-sectional area having a second diagonal;

the outlet area of the housing having an outlet diameter; and a ratio of the outlet diameter to the second diagonal being between 0.9 and 1.1.

9. Gear pump according to claim 1, wherein:

the outlet area of the housing includes an outlet diameter having an insert bushing.

10. Gear pump according to claim 1, further comprising:

a static mixing element connected downstream from the pair of gear wheels.

11. Gear pump according to claim 1 further comprising:

a degassing chamber fluidly coupled to the inlet area.

12. A gear pump, comprising:

a pair of gear wheels each having a gear wheel axis, the pair of gear wheels having a length and a tooth width;

a housing having an outlet area; and an inlet area having an enlargement extending at least to a plane in which both gear wheel axes lie, the enlargement having an enlargement length being parallel to the plane and being at a right angle to the gear wheel axes, the enlargement length being larger than the length of the pair of gear wheels, the enlargement also having an inlet width at the gear wheels in a direction of the gear wheel axes and an inlet depth, the inlet width being greater than the tooth width, a ratio of the enlargement length to the inlet depth being greater than 1.85.

13. Gear pump according to claim 12, wherein:

the pair of gear wheels have a rectangular cross-sectional area and a diagonal across the rectangular cross-sectional area; and the inlet area has an inlet diameter at an entrance, the inlet area also having a cross-sectional area which decreases in a flow direction, the inlet diameter being larger than the diagonal of the rectangular cross-sectional area.

14. Gear pump according to claim 12, wherein:

the enlargement length is at least 10% larger than the length of the pair of gear wheels.

15. Gear pump according to claim 12, wherein:

the inlet width is at least 10% larger than the tooth width.

16. Gear pump according to claim 12, wherein:

the inlet area has an inlet diameter at an entrance, a ratio of the inlet diameter to the inlet depth being at least 2.

17. Gear pump according to claim 12, wherein:

the inlet area comprises a funnel shape having a cone angle of at least 55°.

18. Gear pump according to claim 12, wherein:
the pair of gear wheels has an axial distance between the gear wheel axes; and
a ratio of the tooth width to the axial distance is between 0.9 and 1.3.

19. Gear pump according to claim 12, wherein:
the gear wheel axes of the pair of gear wheels are separated by an axial spacing, the axial spacing and the tooth width defining a cross-sectional area having a second diagonal;
the outlet area of the housing having an outlet diameter; and
a ratio of the outlet diameter to the second diagonal being between 0.9 and 1.1.

20. Gear pump according to claim 12, wherein:
the outlet area of the housing includes an outlet diameter having an insert bushing.

21. Gear pump according to claim 12, further comprising:
a static mixing element connected downstream from the pair of gear wheels.

22. Gear pump according to claim 12 further comprising:
a degassing chamber fluidly coupled to the inlet area.

23. A gear pump, comprising:
a pair of gear wheels each having a gear wheel axis, the pair of gear wheels having a length and a tooth width;
a housing having an outlet area; and
an inlet area having an enlargement extending at least to a plane in which both gear wheel axes lie, the enlargement having an enlargement length being parallel to the plane and being at a right angle to the gear wheel axes, the enlargement length being larger than the length of the pair of gear wheels, the inlet width being on the plane and in a direction of the gear wheel axes, and the inlet width being at least 10% larger than the tooth width.

24. Gear pump according to claim 23, wherein:
the enlargement has a cross-sectional shape on the plane, the cross-sectional shape being a hollow rectangle enclosing the pair of gear wheels.

25. Gear pump according to claim 23, wherein:
the enlargement has a cross-sectional shape on the plane, the cross-sectional shape comprising a sickle-shaped area exterior of the pair of gear wheels.

26. A gear pump, comprising:
a pair of gear wheels each having a gear wheel axis, the pair of gear wheels having a length and a tooth width, the tooth width being in a direction of the gear wheel axes and the length being in a direction perpendicular to the gear wheel axes;
a housing having an outlet area; and
an inlet area having an entrance and an enlargement extending from the entrance to at least a plane in which both gear wheel axes lie, the entrance having an inlet diameter, the inlet diameter being larger than the tooth width, the enlargement length being larger than the length of the pair of gear wheels, the enlargement having a first part and a second part, the first part tapering inwardly from the entrance at a first angle and the second part extending from the first part, the second part tapering inward at a second angle greater than the first angle.

* * * * *